US007263435B2

(12) United States Patent
Mück

(10) Patent No.: US 7,263,435 B2
(45) Date of Patent: Aug. 28, 2007

(54) METHOD FOR DETERMINING A QUEUE IDENTIFICATION NUMBER AND FOR DETERMINING THE LENGTH OF THE QUEUE

(75) Inventor: Jürgen Mück, München (DE)

(73) Assignee: Transver GmbH, München (DE)

( * ) Notice: Subject to any disclaimer, the term of this patent is extended or adjusted under 35 U.S.C. 154(b) by 377 days.

(21) Appl. No.: 10/483,331

(22) PCT Filed: Jul. 10, 2002

(86) PCT No.: PCT/EP02/07708

§ 371 (c)(1),
(2), (4) Date: Aug. 5, 2004

(87) PCT Pub. No.: WO03/007268

PCT Pub. Date: Jan. 23, 2003

(65) Prior Publication Data

US 2004/0267439 A1 Dec. 30, 2004

(30) Foreign Application Priority Data

Jul. 11, 2001 (EP) ..... 01116930

(51) Int. Cl.
*G08G 1/01* (2006.01)

(52) U.S. Cl. ..... 701/117
(58) Field of Classification Search ..... None
See application file for complete search history.

(56) References Cited

U.S. PATENT DOCUMENTS 5,861,820 A * 1/1999 Kerner et al. ..... 340/934

FOREIGN PATENT DOCUMENTS

| | | | |
|---|---|---|---|
| DE | 3621842 | A | 1/1998 |
| EP | 0504638 | A | 9/1992 |
| JP | 03276399 | A | 12/1991 |
| JP | 08161686 | A | 6/1996 |
| JP | 10105865 | A | 4/1998 |

OTHER PUBLICATIONS

Dr. Ansgar Jungel; Modeling and Numerical Approximations of Traffic Flow Problems; Lecture Notes-Universitat Mainz; Winter 2002.*

* cited by examiner

*Primary Examiner*—Michael J. Zanelli
(74) *Attorney, Agent, or Firm*—IP Strategies

(57) ABSTRACT

A method of determining a tailback characteristic factor δ at operating stations for processing individually moving units having alternating hold-back and release phases and having a detector upstream of the respective operating station includes measuring the filling time between the hold-back start or a time instant tied to the hold-back start and continuous occupancy of the detector and subsequent comparison with a reference filling time. A first value is assigned to the tailback characteristic factor δ if the reference filling time is exceeded and a second value is assigned if the reference filling time is not exceeded.

20 Claims, 2 Drawing Sheets

METHOD FOR DETERMINING A QUEUE IDENTIFICATION NUMBER AND FOR DETERMINING THE LENGTH OF THE QUEUE

The present invention relates to a method of determining a tailback characteristic factor δ and self-calibrating methods resulting therefrom for estimating tailback lengths at operating stations for processing individually moving units, such as, for example, traffic-light installations or filters, having a detector situated upstream. The parameters thus determined and the characteristic values derived therefrom may be used to control the traffic-light installation or filters or used to display the traffic status in primary devices.

BACKGROUND OF THE INVENTION

An important matter in road-traffic technology is the determination of tailback lengths at traffic-light installations in order to obtain information items relating to the traffic flow. The knowledge of the tailback lengths may, in addition, serve to control the signal installations (Bernhard Friedrich, *Methoden und Potentiale adaptiver Verfahren für die Lichtsignalsteuerung* (Methods and potentials of adaptive methods for traffic-signal control), Straβenverkehrstechnik 9/1996). According to Joos Bernhard, Thomas Riedel, *Erkennung von Stau mit kurzen Schleifendetektoren* (Detection of tailback using short loop detectors), Straβenverkehrstechnik 7/1999, tailbacks at traffic-light installations can be detected or calculated only between a stop line and detector. The same applies also to tailbacks at any operating stations for processing individually moving units having alternating hold-back and release phases.

A substantial disadvantage of this known method consists in not being able to determine tailback lengths that are greater than the distance between an operating station and detector.

The object of the invention is therefore to provide a method with which a determination of the tailback length at operating stations for processing individually moving units is made possible not only between an operating station and detector in order to control a traffic-light installation or filter with the aid of said tailback length or characteristic values derived therefrom, such as, for example, waiting times, or to display traffic statuses in primary devices.

BRIEF SUMMARY OF THE INVENTION

This object is achieved by a method of determining a tailback characteristic factor δ, with which the tailback length can be determined in a simple way. In addition, other relevant parameters for the installation control, such as, for example, the saturation time requirement, can also be determined using said tailback characteristic factor.

In particular, the present invention provides a method of determining a tailback characteristic factor δ at operating stations for processing individually moving units, each processing phase comprising a hold-back phase and a release phase and a detector being situated upstream of the operating station, by measuring the time (filling time) between the hold-back start or a time instant tied to the hold-back start and continuous occupancy of the detector and subsequent comparison with a reference filling time, wherein a first value is assigned to δ if the reference filling time is exceeded and a second value is otherwise assigned.

A time instant coupled to a transition time before the start of the hold-back phase may also be chosen, for example, as the start of the filling time in addition to the hold-back start. In the case of traffic lights, the amber phase would be suitable as transition time.

If the reference filling time is dropped below, that is to say if the distance between an operating station and detector is filled more rapidly than in the reference time, a tailback may be assumed. Otherwise, the units are in free flow.

In this connection, the reference filling time is obtained, for example, from simulator tests or empirical investigations. Advantageously, the reference filling time is chosen as a function of the geometry of the inflow region, for example of the distance between a detector and a filling station, the lane width, etc., and/or of the release time of the operating station.

Using the tailback characteristic factor δ determined in the way described above, a multiplicity of relevant parameters for optimizing throughput or a traffic status display can be determined.

A first method of estimating tailback length $\hat{L}_n$ using the tailback characteristic factor determined according to the invention in the $n^{th}$ processing phase is based on the assumption that, as a linear function of a smoothed tailback characteristic factor $\hat{\delta}_n$ that is determined from the tailback characteristic factor $\delta_n$ taking into account the $(n-1)^{th}$ smoothed tailback characteristic factor $\hat{\delta}_{n-1}$, $\hat{L}_n$ is given by:

$$\hat{L}_n(\hat{\delta}_n)=m\hat{\delta}_n, \tag{1}$$

where $\hat{\delta}_n$ may no longer assume only two values, but a plurality of values. With a Specified m, the tailback length for a given $\hat{\delta}_n$ is given by equation (1). The tailback characteristic factor is smoothed in order to avoid excessively large changes in the tailback characteristic factor from one processing phase to the next.

This method is distinguished by the fact that speed measurements are not necessary to determine the tailback length.

Advantageously, the slope is readjusted in each $n^{th}$ processing phase. For this purpose, the traffic level $q_n$ is determined. This is given, for example, by an estimate or by the measured number of units that pass the detector during the $n^{th}$ processing phase. It can be calculated from the traffic level how many units were present during the $n^{th}$ hold-back phase at least upstream of the operating station; a lower limit $L_n^0$ is consequently obtained for the tailback length. On the other hand, the tailback-length function of the previous processing step $\hat{L}_{n-1}(\hat{\delta}_n)=m_{n-1}\hat{\delta}_n$ with $\hat{\delta}_n$ and a suitably chosen $m_{n-1}$ yields an estimate of the actual tailback length in the current processing phase. By comparing $L_n^0$ and $\hat{L}_{n-1}(\hat{\delta}_n)$, $m_n$ and, consequently, $\hat{L}_n$ can be calibrated.

The slope of the $(n-1)^{th}$ processing phase is advantageously obtained by recursive application of the method just described with suitable starting values for $\hat{\delta}_0$ and $m_0$. This method is consequently self-calibrating.

Preferably, the tailback characteristic factor is smoothed by forming a convex combination of the current tailback characteristic factor and the smoothed tailback characteristic factor of the previous processing:

$$\hat{\delta}_n=\alpha\delta_n+(1-\alpha)\,\hat{\delta}_{n-1},\ \alpha\in[0,1] \tag{2}$$

The traffic level $q_n$ is preferably measured using the detector located upstream of the operating station.

In an advantageous version, the lower limit of the tailback length $L_n^0$ is given as a linear function of $q_n$ since even this simple form is a good approximation. Preferably, the slope of this straight line depends on the time in which the detector is continuously occupied during a portion of the processing phase. If this dependence is taken into account, the agreement with real data is improved.

It is advantageous to alter the slope $m_n$ only if either $\delta_n$ has assumed the second value and $L_n^0 > \hat{L}_{n-1}(\hat{\delta}_n) = m_{n-1}\hat{\delta}_n$ or if $\delta_n$ has assumed the first value and $L_n^0 < \hat{L}_{n-1}(\hat{\delta}_n) = m_{n-1}\hat{\delta}_n$. In the first case, $\delta_n$ shows, on the one hand, a tailback at a distance of at least $L_n^0$ from the operating station and, on the other hand, the estimate of the tailback length $\hat{L}_{n-1}(\hat{\delta}_n)$ is below $L_n^0$. In the second case, although $\delta_n$ does not indicate a tailback of length $L_n^0$, the tailback is, on the other hand, still longer than $L_n^0$ according to the estimate $\hat{L}_{n-1}(\hat{\delta}_n)$. In both cases, therefore, it is appropriate to calibrate the slope $m_n$. If, on the other hand, the value of the tailback characteristic factor and the estimated tailback length are not inconsistent, the slope is retained: $m_n = m_{n-1}$.

To adapt the slope $m_n$, a smoothed tailback length $L'_n$ may be used that results as a combination of $L_n^0$ and $\hat{L}_{n-1}(\hat{\delta}_n)$:

$$L_n' = \beta L_n^0(q_n) + (1-\beta)\hat{L}_{n-1}(\hat{\delta}_n),\ \beta > 0 \tag{3}$$

The tailback characteristic factor $\delta$ determined by the method according to the invention described above may also be used to determine the saturation time requirement; this is the average time requirement value of a unit in saturated (no longer free) flow during the release phase. The saturation time requirement is, on the one hand, a measure of the performance of the operating station. On the other hand, it may also serve to estimate tailback length by means of a queuing model.

To determine the saturation time requirement $t_n^B$ in the $n^{th}$ processing step, the tailback characteristic feature $\delta$ is first determined using the method according to the invention and the traffic level $q_n$ is measured or estimated. The saturation time requirement can then be calculated, using a suitable starting condition for $t_0^B$, by means of $$t_n^B = \begin{cases} \dfrac{t_n^q}{q_n}, & \text{if } \delta_n = \delta_{n-1} \text{ is equal to the second value,} \\ t_{n-1}^B, & \text{otherwise.} \end{cases} \tag{4}$$

where $t^g_n$ is the release time in the $n^{th}$ processing step.

In order to avoid excessively large changes in the saturation time requirement from one processing step to the next, only a specified maximum change $\Delta t^B_{max} > 0$ of the saturation time requirement is preferably permitted in each step. If, therefore, the $t_n^B$ obtained from equation (4) fulfils one of the inequalities:

$$\Delta t^B - t^B_n - t^B_{n-1} > \Delta t^B_{max} \text{ or } \Delta t^B < -\Delta t^B_{max} \tag{5}$$

a modified saturation time requirement $\hat{t}^B_n$ is advantageously calculated, where $$\hat{t}^B_n = t^B_{n-1} + \Delta t^B_{max} \text{ or } \hat{t}^B_n = t^B_{n-1} - \Delta t^B_{max} \tag{6}$$

It is advantageous to measure the traffic level $q_n$ using the detector situated upstream of the operating station.

As an alternative to the method according to the invention described above, the tailback length can be determined with the aid of a queuing model that comprises an inherent model saturation time requirement $\tau^B_n$ having a suitably chosen start value as parameter to be calibrated. Such a method may comprise in any nth processing operation:

Next, the actual saturation time requirement $t^B_n$ is determined in accordance with the method according to the invention described above. If the saturation requirement value of the last processing phase changes by $\Delta t^B$, the inherent model saturation requirement valuo $\tau^B_n$ is adapted using $$\tau^B_n = \tau^B_{n-1} + c_d \Delta t^B \tag{7}$$

where $C_d$ denotes a suitably chosen damping constant. In particular, the inherent model saturation requirement value is adapted using $$\tau^B_n = \tau^B_{n-1} + c_d \operatorname{sgn}(\Delta t^B) \min\{|\Delta t^B|, \Delta t^B_{max}\} \tag{8}$$

if only a maximum change of $\Delta t^B_{max}$ is permitted for the actual saturation requirement value, where $\operatorname{sgn}(\Delta t^B)$ denotes the sign of $\Delta t^B$. A lower limit for the tailback length $L^0_n$ is calculated from the traffic level. Using these quantities, a first estimate of the tailback length $L''_n$ is calculated with the aid of a queuing model. Then $L''_n$ and $L^0_n$ are compared in a way analogous to the above method of tailback length estimation. If $L''_n > L^0_n$ and $\delta_n$ has assumed the first value or if $L''_n < L^0_n$ and $\delta_n$ has assumed the second value, the inherent model saturation time requirement has to be modified. Using the calibrated model saturation time requirement, a calibrated estimate of the tailback length is then calculated using the tailback model.

This method is distinguished in that no speed measurements are necessary for determining the tailback length.

Furthermore, faults in the outflow can advantageously be taken into account and a suitably modified traffic level used in the queuing model.

In a beneficial version of the fault compensation, $q_n$ is modified only if it is less than the second-largest value $\max_{10,2}(q)$ of the last ten q values. In this case, a time interval during the processing phase is chosen to calculate the fault compensation and predetermined, shorter time intervals, for example the full seconds in which the detector is continuously occupied in the total interval, are counted. The entire interval preferably begins a few seconds after the start of the release phase and finishes a few seconds after the end of the release phase. If the number thus obtained is divided by the length of the entire interval, the degree of occupancy $b \in [0,1]$ of the detector is obtained. If b drops below a lower limit u, the value 0 is assigned to a fault characteristic factor s. If b exceeds an upper limit o, the value 1 is assigned to s. If $u \leqq b \leqq o$, s is given by $$s = \frac{b-u}{o-u} \tag{9}$$

As a modified traffic level q'n $$q'_n = q + s(1 + P_{comp})(\max_{10,2}(q) - q) \tag{10}$$

is then taken, where $P_{comp}$ is a constant with which the level of the fault compensation can be adjusted.

The inherent model saturation time requirement is advantageously calibrated using a feedback method based on a conventional PID regulator (proportional-integral-differential regulator). For this purpose, −1 should be assigned to $\delta_n$ as the first value (if there is no tailback) and 1 should be assigned as the second value (if there is a tailback). The calibration uses two variables: $\tilde{s}_n$ (corresponds to a sawtooth integrating term) and $\tilde{d}_n$ (corresponds to a differentiating member). If $\delta_n L''_n \geqq \delta_n L^0_n$, $\tilde{s}_n = \tilde{d}_n = 0$ and the saturation time requirement is unaltered. Otherwise, the auxiliary variable $$A = \frac{t_n^B}{t_n^g}(L''_n - L_n^0) \tag{11}$$

is defined.

In order to avoid overcorrecting the saturation time requirement, $$A' = \mathrm{sgn}(A)\min\{|A|, 1\} \tag{12}$$

can be defined, where sgn(A) denotes the sign of A. There are now chosen $$\tilde{s}_n = \begin{cases} \tilde{s}_{n-1} - \delta_n, & \text{if } \tilde{s}_{n-1}\delta_n < 0 \\ -\delta_n, & \text{otherwise} \end{cases} \tag{13}$$

and $$\tilde{d}_n = \begin{cases} \dfrac{\tilde{d}_{n-1}}{t_d}, & \text{if } \tilde{d}_{n-1}\delta_n < 0 \\ -\delta_n, & \text{otherwise} \end{cases} \tag{14}$$

where $t_d$ is a constant to be suitably chosen. This then yields the calibrated saturation time requirement for the queuing model $$\tilde{\tau}^B_n = \tau^B_n - (p_p A' + |A'|(p_i \tilde{s}_n + p_d \tilde{d}_n)) \tag{15}$$

where $p_p$, $p_i$ and $p_d$ denote the parameters of the regulator.

It is advantageous to smooth the calculated tailback length by forming a convex combination of $L^0_n$ and $L''_n$:

$$L_n = \gamma L^0_n + (1-\gamma)L''_n,\ \gamma \in [0,1]. \tag{16}$$

This avoids an overcorrection of the tailback length.

Two methods according to the invention of determining the tailback length estimation with the aid of the method according to the invention of determining the tailback characteristic factor are described below with reference to the drawing. In the drawing:

FIG. 2 shows the estimated tailback (in vehicles) as a function of the explicitly measured, smoothed tailback from method 1, FIG. 3 shows the estimate of the tailback time requirement $t^B_n$ as a function of time from method 2.

DETAILED DESCRIPTION OF THE INVENTION

Method 1

The application of the method of tailback length estimation and its verification is shown at an approach to a heavily loaded traffic-light installation (in the town direction of the Landsberger/Trappentreustrasse, Munich) with strongly varying green times (release times).

The detector is located 30 m or approximately 5 vehicles away from the stop line. As a reference filling time for this distance, 22 seconds is assumed.

If the reference filling time is exceeded, the value 0 is assigned to $\delta$ and otherwise, the value 1 is assigned. The tailback characteristic factor is smoothed in that $\hat{\delta}_n = \alpha\delta_n + (1-\alpha)\hat{\delta}_{n-1}$, where $\alpha$ is typically between 0.05 and 0.2 and $\delta_0 = \hat{\delta}_0 = 0$.

The lower limit is calculated by means of $$L^0_n = q_n\sqrt{1-\min(\gamma_1, b\gamma_2)} + \alpha_1\gamma_i \geqq 0, \tag{17}$$

where $\alpha_1$ takes account of the vehicles between the detector and stop line and therefore assumes the value $\alpha_1 = 5$. In this exemplary embodiment, $\gamma_1$ is chosen as =0.9 and $\gamma_2$ is chosen as =1.2. The degree of occupancy b of the detector is obtained by counting the full seconds between 5 s after the start of release and 15 s after the end of release in which the detector is continuously occupied, and then dividing by the total length of this time interval; consequently, b is always $\in [0,1]$.

The slope $m_n$ is written as $m_n = m'_n / m''_n$ in this example, where $m'_0 = 10$ and $m''_0 = 0.5$ form suitable start values. The slope is modified by means of a smoothed value $L'_n = \beta L^0_n(q_n) + (1\beta)\hat{L}_{n-1}(\hat{\delta}_n)$, where $\beta = 0.7$. It is the case that $$m'_n = \begin{cases} \dfrac{(k_{n-1}-1)m'_{n-1} + \hat{\delta}_n L'_n}{k_{n-1}}, & \text{if the values of } \delta \text{ and } L_n^0 \text{ are inconsistent} \\ m'_{n-1}, & \text{otherwise,} \end{cases} \tag{18}$$

and $$m''_n = \begin{cases} \dfrac{(k_{n-1}-1)m''_{n-1} + \hat{\delta}_n^2}{k_{n-1}}, & \text{if the values of } \delta \text{ and } L_n^0 \text{ are inconsistent} \\ m''_{n-1}, & \text{otherwise,} \end{cases} \tag{19}$$

where $$k_n = \begin{cases} \min\{k_{n-1}+1, K\}, & \text{if the values of } \delta \text{ and } L_n^0 \text{ are inconsistent} \\ k_{n-1}, & \text{otherwise,} \end{cases} \tag{20}$$

BRIEF DESCRIPTION OF THE DRAWINGS

FIG. 1 shows the calibration of the slope $m_n$. The arbitrarily specified value of approximately 20 increases on the first day to tho value that corresponds to the traffic characteristic of the lane. Only slight adaptation processes then occur. The control behaviour is stable and robust.

A squared correlation coefficient of $R^2=0.7748$ indicates a good relationship between estimated and real tailback length.

Method 2

As an application of the method, the determination of the tailback length at the approach mentioned in the above example to a traffic-light installation is described with the aid of a queuing model.

To calculate the saturation time requirement, a maximum change of $\Delta t^B_{max}=0.02$ is permitted. The change is additionally damped in the queuing model by the factor $c_d=0.9$.

Figure 1:
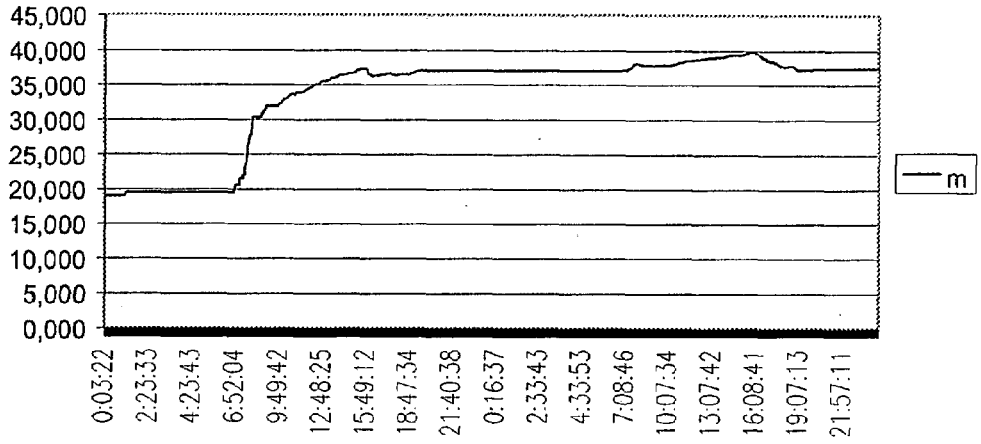
FIG. 1 shows the calculated slope $m_n$ of the tailback-length function as a function of time from method 1, Suitable values for a fast, but stable estimate are $k_0 = 10$ and $K = 1000$.
Figure 2:
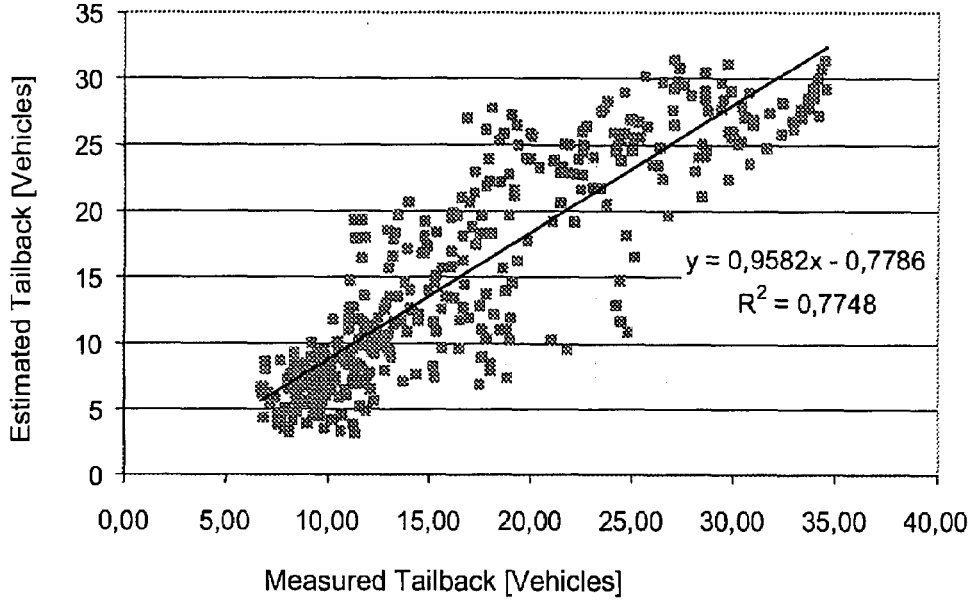
FIG. 2 shows the comparison of the estimated, smoothed tailback length with manually increased, slightly smoothed tailback length values. The measured tailback $L^{real}_n$ was smoothed using $$\hat{L}^{real}_n = 0.3L^{real}_n + 0.7\hat{L}^{real}_{n-1} \tag{21}$$
Figure 3:
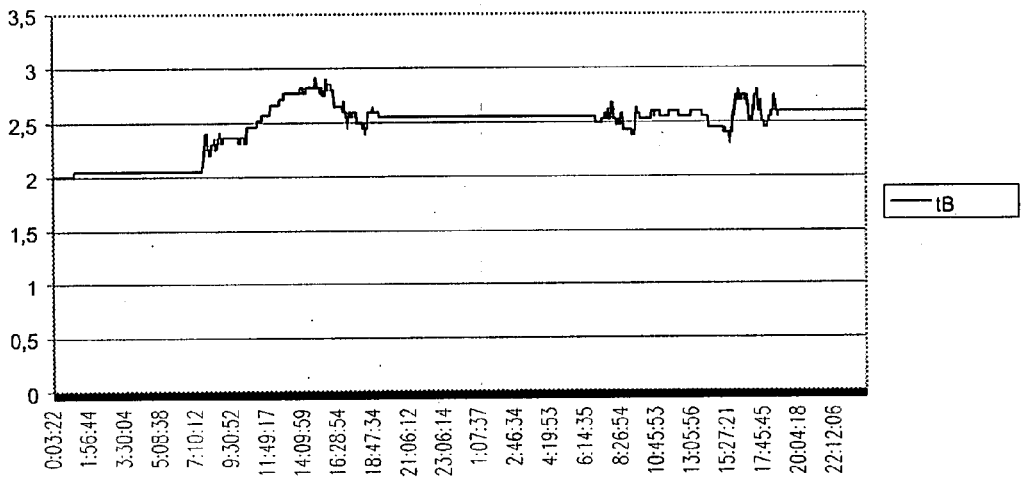

FIG. 3 shows the determination of the time requirement value $t^B_n$ as a function of time for a start value of $t^B_0=2$s. It can be seen that, in addition to the transient oscillation process, fluctuations occur in $t^B_n$ several times within the two working days. These fluctuations are explained, inter alia, by variable traffic patterns and driving behaviour of road users that is dependent on the time of day.

Faults in the outflow are compensated by means of the degree of occupancy known from the above example. The fault characteristic factor s is given by equation (9), where u=0.2 and o =1.1 are used for the limits. This choice guarantees that s is always less than 1.

In this example, the macroscopic queuing model is taken from R. M. Kimber and E. M. Hollis, *Traffic queues and delays at road junctions*, TRRL Laboratory Report 909, Berkshire, 1979. The model equation for the tailback length L is $$L = \frac{1}{2}\left(\sqrt{A^2 + B} - A\right) \tag{22}$$

where $$A = \frac{\left(1 + q\frac{\tau^B}{t^g_n}\right)\left(\frac{t^g_n}{\tau^B}\right)^2 + (1 - L_{n-1})\frac{t^g_n}{\tau^B} - 2(1 - C)(L_{n-1} + q)}{\frac{t^g_n}{\tau^B} + (1 - C)} \tag{23}$$

and $$B = \frac{4(L_{n-1} + q)\left(\frac{t^g_n}{t^B} - (1 - C)(L_{n-1} + q)\right)}{\frac{t^g_n}{\tau^B} + (1 - C)} \tag{24}$$

where C=0.6 characterizes the statistical fluctuations in the outflow.

Suitable parameters for calibrating the saturation time requirement analogously to a PID controller are $p_d=0.003$, $p_i=0.01$, $p_d=0.01$ and $t_d=1.2$.

The tailback-length estimate is smoothed using $\gamma=0.6$.

The invention claimed is:

1. Method of determining a tailback characteristic factor δ at operating stations for processing individually moving units having alternating hold-back and release phases and having a detector upstream of the respective operating station by measuring the filling time between the hold-back start or a time instant tied to the hold-back start and continuous occupancy of the detector and subsequent comparison with a reference filling time, in which method a first value is assigned to the tailback characteristic factor δ if the reference filling time is exceeded and a second value is assigned if the reference filling time is not exceeded.

2. Method according to claim 1, in which the reference filling time is chosen as a function of the geometry of the inflow region of the operating station.

3. Method according to claim 1, in which the reference filling time is chosen as a function of the release time.

4. Method of determining the saturation time requirement $t_n^B$, which corresponds to the average time requirement of a unit with saturated flow during the release phase, by (a) determining the tailback characteristic factor according to claim 1, (b) determining the traffic level $q_n$, (c) determining the saturation time requirement $t_n^B$ using the release time $t_n^q$ and a suitable starting condition for $t_0^B$ in accordance with $$t^B_n = \begin{cases} \frac{t^g_n}{q_n}, & \text{if } \delta_n = \delta_{n-1} \text{ is equal to the second value,} \\ t^B_{n-1}, & \text{otherwise.} \end{cases}$$

5. Method according to claim 4, in which the saturation time requirement $t^B_n$ is altered in each nth processing phase by not more than a predetermined maximum value compared with the saturation time requirement of the $(n-1)^{th}$ processing phase.

6. Method according to claim 4, in which the traffic level $q_n$ is measured with the detector upstream of the operating station.

7. Method of determining the tailback length $L''_n$ by (a) determining the saturation time requirement $t^B_n$ according to claim 4, (b) determining an inherent model saturation time requirement $\tau^B_n$ in accordance with $\tau_n^B=\tau^B_{n-1}+c_d(t^B_n-t^B_{n-1})$ using an $(n-1)^{th}$ model saturation time requirement $\tau^B_{n-1}$ and with a suitably chosen $C_d$, (c) calculating a lower limit of the tailback length $L_n^0$ as a function of $q_n$, (d) calculating a tailback length estimation with a queue model using the inherent model saturation time requirement, (e) calibrating the inherent model saturation requirement by comparing the tailback length estimation with the lower limit $L_n^0$, (f) calculating the tailback length $L_n''$ with a queuing model using the calibrated inherent model saturation time requirement.

8. Method according to claim 7, in which the tailback length calculation is made with a modified traffic level that takes account of faults in the outflow.

9. Method according to claim 8, in which the flow compensation is calculated by counting in a time interval during the processing phase predetermined time intervals, in particular complete seconds, in which the detector is continuously occupied.

10. Method according to claim 7, in which the inherent model saturation time requirement is calibrated using a classic PID controller method.

11. Method according to claim 7, in which the tailback length estimation is smoothed by forming a convex combination of $L_n^0$ and $L_n''$ in accordance with $L_n=\gamma L_n^0+(1-\gamma)L_n''$, $\gamma\in[0,1]$.

12. Method of determining the tailback length $\hat{L}_n$ in the nth processing phase by (a) determining the nth tailback characteristic factor $\delta_n$ according to claim 1, (b) calculating a smoothed tailback characteristic factor $\hat{\delta}_n$ using the $(n-1)^{th}$ smoothed tailback characteristic factor $\hat{\delta}_{n-1}$, (c) determining the tailback length $\hat{L}_n(\hat{\delta}_n)=m\hat{\delta}_n$ with suitably predetermined slope m.

13. Method according to claim 12, wherein the slope $m_n$ is determined in the nth processing phase by (a) determining the traffic level $q_n$, (b) calculating a lower limit $L_n^0$ for the tailback length as a function of $q_n$, (c) determining the slope $m_n$ by comparison of $L_n^0$ with $\hat{L}_{n-1}(\hat{\delta}_n)$ with a suitably predetermined slope $m_{n-1}$.

14. Method in which the slope $m_{n-1}$ is determined by recursive application of the method according to claim 13 with suitable starting conditions for $m_0$ and $\hat{\delta}_0$.

15. Method according to claim 13, in which the traffic level $q_n$ is measured with a detector situated upstream of the operating station.

16. Method according to claim 13, in which the lower limit $L_n^0$ of the tailback length is predetermined as a linear function of $q_n$.

17. Method according to claim 16, in which the slope $L_n^0(q_n)$ is predetermined as a function of the time, in which the detector is continuously occupied during a portion of the processing phase.

18. Method according to claim 13, in which the slope $m_n$, is altered with respect to $m_{n-1}$ if the second value is assigned to $\delta_n$ and $L_n^0>\hat{L}_{n-1}(\hat{\delta}_n)=m_{n-1}\hat{\delta}_n$ or if the first value is assigned to $\delta_n$ and $L_n^0<\hat{L}_{n-1}(\hat{\delta}_n)=m_{n-1}\hat{\delta}_n$ and otherwise $m_n=m_{n-1}$ is set.

19. Method according to claim 13, in which the slope $m_n$ is adapted by means of a smoothed value $$L_n'=\beta L_n^0(q_n)+(1-\beta)\hat{L}_{n-1}(\hat{\delta}_n) \text{ where } \beta>0.$$

20. Method according to claim 12, in which the smoothed tailback characteristic factor $\hat{\delta}_n$ is calculated as a convex combination of $\delta_n$ and $\hat{\delta}_{n-1}$ in accordance with $\hat{\delta}_n=\alpha\delta_n+(1-\alpha)\hat{\delta}_{n-1}$, $\alpha\in[0,1]$.

* * * * *